US009403256B2

(12) United States Patent
Yavelberg

(10) Patent No.: US 9,403,256 B2
(45) Date of Patent: Aug. 2, 2016

(54) RECORDING MEASUREMENTS BY SENSORS FOR A CARRIER HEAD

(71) Applicant: Applied Materials, Inc., Santa Clara, CA (US)

(72) Inventor: Simon Yavelberg, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 14/081,307

(22) Filed: Nov. 15, 2013

(65) Prior Publication Data

US 2014/0138355 A1 May 22, 2014

Related U.S. Application Data

(60) Provisional application No. 61/727,544, filed on Nov. 16, 2012.

(51) Int. Cl.

| | |
|---|---|
| ***H01L 21/306*** | (2006.01) |
| ***B24B 37/005*** | (2012.01) |
| ***B24B 37/30*** | (2012.01) |
| ***B24B 7/22*** | (2006.01) |

(52) U.S. Cl.

CPC ..... *B24B 37/005* (2013.01); *B24B 7/228* (2013.01); *B24B 37/30* (2013.01)

(58) Field of Classification Search

CPC ..... B24B 37/205; B24B 37/27; B24B 37/30
USPC ..... 216/88, 89, 91; 438/692; 156/345.12, 156/345.13, 345.14
See application file for complete search history.

(56) References Cited

U.S. PATENT DOCUMENTS

| | | | | |
|---|---|---|---|---|
| 5,738,574 | A | 4/1998 | Tolles et al. | |
| 6,183,354 | B1 | 2/2001 | Zuniga et al. | |
| 6,663,466 | B2 | 12/2003 | Chen et al. | |
| 7,699,688 | B2 | 4/2010 | Zuniga et al. | |
| 2002/0049024 | A1 * | 4/2002 | Zuniga et al. | 451/8 |
| 2004/0242123 | A1 * | 12/2004 | Wiswesser et al. | 451/5 |
| 2007/0102116 | A1 * | 5/2007 | Shanmugasundram | B24B 37/013 156/345.13 |
| 2008/0004743 | A1 | 1/2008 | Goers et al. | |
| 2011/0035186 | A1 * | 2/2011 | Liu et al. | 702/182 |
| 2012/0028813 | A1 | 2/2012 | Qian et al. | |

FOREIGN PATENT DOCUMENTS

| | | |
|---|---|---|
| JP | 2006-332520 | 12/2006 |
| KR | 10-1999-0013784 | 2/1999 |
| KR | 10-2005-0008231 | 1/2005 |

OTHER PUBLICATIONS

International Search Report and Written Opinion in International Application No. PCT/US2013/068817, mailed Feb. 26, 2014, 10 pages.

* cited by examiner

*Primary Examiner* — Binh X Tran
(74) *Attorney, Agent, or Firm* — Fish & Richardson P.C.

(57) ABSTRACT

A pressure control assembly for a carrier head of a polishing apparatus includes a pressure supply line configured to fluidically connect to a chamber of a carrier head, a sensor to responsive to pressure in the chamber and configured to generate a signal representative of the pressure, and a pneumatic control unit configured to receive the signal, to control a pressure applied to the pressure supply line, and to record the signal in a non-transitory storage media of a storage device removably attached to the pneumatic control unit.

13 Claims, 1 Drawing Sheet

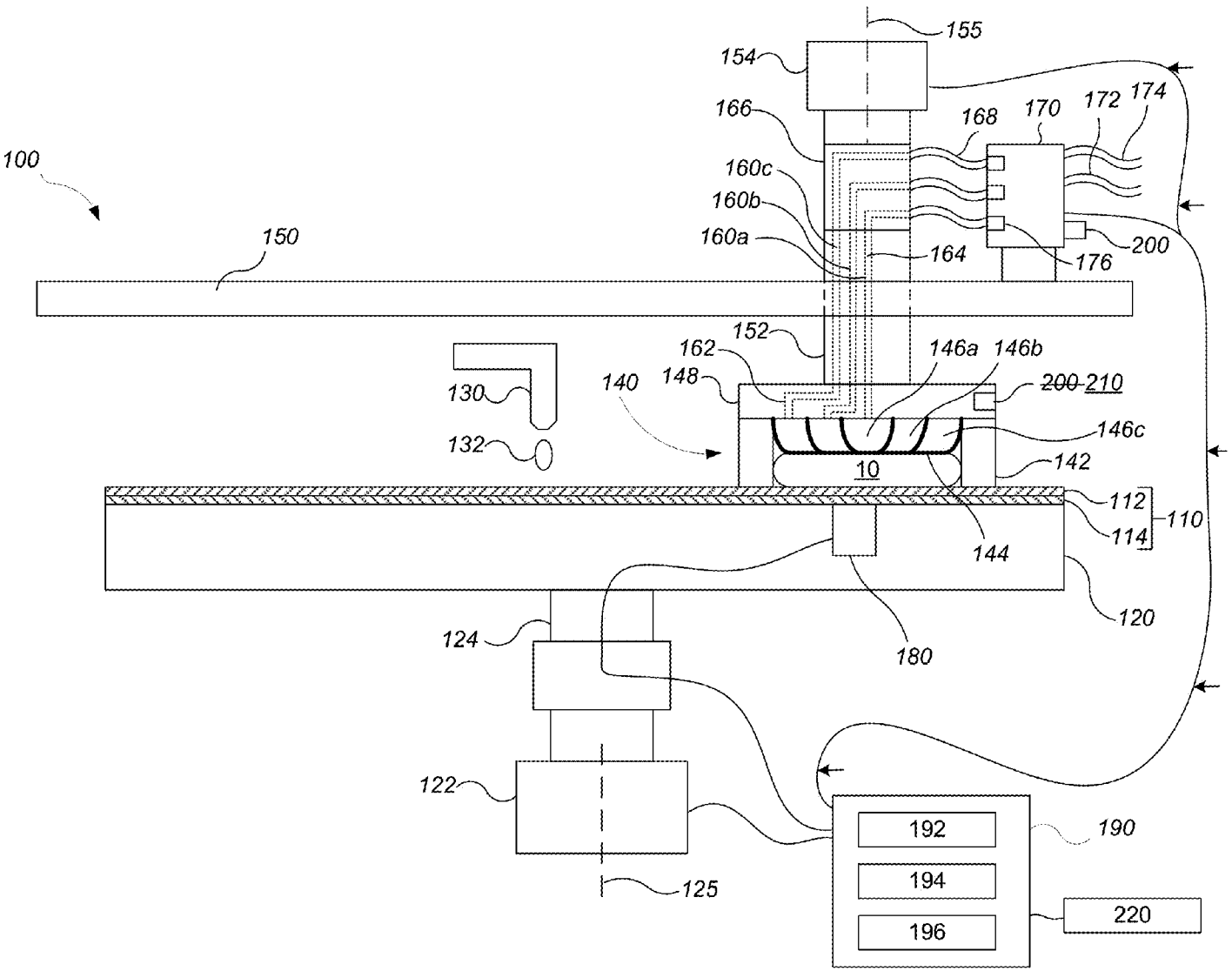
100
150
130
132
140
154
155
166
160c
160b
160a
168
164
170
172
174
176
200
152
162
148
146a
146b
200-210
146c
142
144
10
110
112
114
120
124
122
125
180
190
192
194
196
220

RECORDING MEASUREMENTS BY SENSORS FOR A CARRIER HEAD

CROSS-REFERENCE TO RELATED APPLICATIONS

This application claims priority to U.S. Provisional Patent Application Ser. No. 61/727,544, filed Nov. 16, 2012.

TECHNICAL FIELD

This disclosure relates to sensor measurements during chemical mechanical polishing.

BACKGROUND

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar.

Chemical mechanical polishing (CMP) is one accepted method of planarizing a substrate surface. This planarization method typically requires that the substrate be mounted to a carrier or polishing head. The exposed surface of the substrate is then placed against a rotating polishing pad.

Some carrier heads include a flexible membrane with a mounting surface for the substrate. One or more chambers on the other side of the membrane can be pressurized to press the substrate against the polishing pad. A pneumatic control unit system outside the carrier head can control the pressures applied to the chambers, e.g., through pressure supply lines, in order to control the pressures applied to the substrate.

SUMMARY

One problem that has been encountered in CMP is that a carrier head includes multiple parts, e.g., membranes, that can fail during operation. Premature failure of the parts can be difficult to analyze due to the multiple interacting factors. However, a dedicated memory can be used to record signals from sensors in or associated with the carrier head, e.g., sensors that measure the pressure in the chambers. The recorded signals can then be used in a variety of techniques, e.g., the carrier head operations can be rerun in order to understand factors contributing to the fault, or the signals can be compared against a standard signature to detect drifting conditions.

In one aspect, a pressure control assembly for a carrier head of a polishing apparatus includes a pressure supply line configured to fluidically connect to a chamber of a carrier head, a sensor to responsive to pressure in the chamber and configured to generate a signal representative of the pressure, and a pneumatic control unit configured to receive the signal, to control a pressure applied to the pressure supply line, and to record the signal in a non-transitory storage media of a storage device removably attached to the pneumatic control unit.

Implementations may include one or more of the following features. The storage device may include a flash memory. The pneumatic control unit may include a USB port and the pneumatic control unit may be configured to record the signal to the storage device attached to the USB port. The pneumatic control unit may be configured to record the signal acquired during processing of a plurality of substrates. The pneumatic control unit may be configured to cause the storage device to store signals received during processing of a most recent plurality of substrates. The most recent plurality of substrates may include at most 20 substrates. Processing of the plurality of substrates may include one or more of loading or unloading the substrate at a loading station, sensing the presence of the substrate, chucking or dechucking the substrate from the polishing pad, or polishing the substrate. The pneumatic control unit may be configured to sample the signal at a sampling rate to generate a sequence of measured signal values, and may be configured to store the sequence of measured signal values to record the signal. The sampling rate may be at least 10 Hz. A plurality of pressure supply lines may be configured to fluidically connect to chambers of the carrier head. A plurality of sensors may be configured to be responsive to pressures in the chambers and to generate signals representative of the pressures. The pneumatic control unit may be configured to receive the signals and record the signals in the non-transitory storage media of the storage device.

In another aspect, a method of operating a polishing system includes holding a substrate in a carrier head in a polishing system, processing the substrate, generating a signal representative of a pressure in a chamber in the carrier head, recording the signal in a non-transitory storage media of a storage device removably attached to a pneumatic control unit for the carrier head, and after recording, detaching the storage device from the pneumatic control unit.

Implementations may include one or more of the following features. The carrier head may be detached from the polishing system. The carrier head and the storage device may be sent to a repair facility. A fault may be detected in the carrier head and/or a pressure assembly, and the storage device may be detached in response to detecting the fault. The signal in the storage device may be analyzed.

In another aspect, a method of operating a polishing system includes loading a pressure signature into a non-transitory storage media of a storage device, after loading, attaching the storage device to a pneumatic control unit for a carrier head in a polishing system, processing the substrate, generating a signal representative of a pressure in a chamber in the carrier head, and comparing the signal to the pressure signature.

Implementations may include one or more of the following features. An alert may be generated if the signal varies by more than a threshold amount from the pressure signature.

Advantages of implementations may optionally include one or more of the following. A failure in a carrier head may be easier to analyze, e.g., the cause of the failure may be easier to determine. Potential failure of parts can be detected. Parts can be replaced prior to failure, thus reducing the risk of damage to substrates due to failure in the carrier head and improving yield.

The details of one or more implementations are set forth in the accompanying drawings and the description below. Other features, objects, and advantages will be apparent from the description and drawings, and from the claims.

DESCRIPTION OF DRAWINGS

FIG. 1 is a schematic diagram of a chemical mechanical polishing system.

Like reference symbols in the various drawings indicate like elements.

DETAILED DESCRIPTION

FIG. 1 illustrates an example of a polishing apparatus 100. A description of a CMP apparatus may be found in U.S. Pat. No. 5,738,574, the entire disclosure of which is incorporated herein by reference.

The polishing apparatus 100 includes a rotatable disk-shaped platen 120 on which a polishing pad 110 is situated. The polishing pad 110 can be a two-layer polishing pad with an outer polishing layer 112 and a softer backing layer 114. The platen is operable to rotate about an axis 125. For example, a motor 122 can turn a drive shaft 124 to rotate the platen 120.

The polishing apparatus 100 can include a port 130 to dispense polishing liquid 132, such as abrasive slurry, onto the polishing pad 110. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. In addition, the carrier head 140 can load or unload the substrate at a loading station, sense the presence of the substrate, and chuck or dechuck the substrate from the polishing pad. Each carrier head 140 can have independent control of the polishing parameters, for example pressure, associated with each respective substrate.

The carrier head 140 can include a retaining ring 142 to retain the substrate 10 below a flexible membrane 144. The carrier head 140 also includes one or more independently controllable pressurizable chambers defined by the membrane, e.g., three chambers 146*a*-146*c*, which can apply independently controllable pressures to associated zones on the flexible membrane 144 and thus on the substrate 10. Although only three chambers are illustrated in FIG. 1 for ease of illustration, there could be one or two chambers, or four or more chambers, e.g., five chambers. In addition, although the retaining ring 142 is illustrated as fixed to the carrier head 140, there can be a chamber that controls the downward pressure of the retaining ring on the polishing pad 110.

The carrier head can also include a base 148 to which the retaining ring 142 is connected. The base 148 can be directly secured to a drive shaft 152. Alternatively, the base 148 can be connected to a housing which is secured to the drive shaft 152, and a chamber between the base 148 and the housing can control the vertical position of the base 148. Other features of the carrier head may be found in U.S. Pat. No. 7,699,688, the entire disclosure of which is incorporated herein by reference.

The carrier head 140 is suspended from a support structure 150, e.g., a carousel, and is connected by the drive shaft 152 to a carrier head rotation motor 154 so that the carrier head can rotate about an axis 155. Optionally each carrier head 140 can oscillate laterally, e.g., on sliders on the carousel 150, or by rotational oscillation of the carousel itself. In typical operation, the platen is rotated about its central axis 125, and each carrier head is rotated about its central axis 155 and translated laterally across the top surface of the polishing pad.

Each chamber 146*a*-146*c* is fluidically connected by an associated pressure supply line 160*a*-160*c* to a pneumatic control system 170, e.g., a system of pressure sensors and valves that can regulate pressure in the pressure supply line 160*a*-160*c* and thus the pressure in the associated chamber 146*a*-146*c*. The pneumatic control system 170 is coupled to a fluid supply line 172, e.g., a source of pressurized air, nitrogen or other gas. The pneumatic control system 170 is also coupled to a vacuum line 174. The pneumatic control system 170 can selectively couple the respective pressure supply lines 160*a*-160*c* to the fluid supply line 172 or the vacuum line 174. The collection of the pressure supply lines 160*a*-160*c* and pressure control system 170 can be considered an "upper pressure assembly" (UPA).

Each pressure supply line 160*a*-160*c* can include a passage 162 that extends through the base 148, a passage 164 in the drive shaft 152, a rotary coupler 166, and tubing 168, e.g., a pipe or hose. A first end of the passage 162 in the base 148 opens to an associated chamber 146*a*-146*c*. A second end of the passage 162 in the base 148 can be connected to the first end of the passage 164 in the drive shaft 152. A second end of the passage 164 in the drive shaft 152 can be connected to a first end of the tubing 168 by the rotary coupler 166. A second end of the tubing 168 is connected to the pneumatic control system 170. However, many other arrangements are possible for the pressure supply lines 160*a*-160*c*. For example, if the drive shaft 152 does not rotate, then the rotary coupler 166 could be omitted or the tubing 166 could be connected directly to the carrier head 140 (bypassing the drive shaft 152).

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

A controller 190, such as a programmable computer with a microprocessor 192, memory 194 and I/O system 196, is connected to the motors 122, 154 to control the rotation rate of the platen 120 and carrier head 140. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing apparatus can optionally include an in-situ monitoring system with a sensor 180 to monitor the substrate during polishing. The in-situ monitoring system can be, for example, an optical monitoring system, an eddy current monitoring system, or a motor current monitoring system, which can be used to determine a polishing endpoint.

The controller 190 can be configured to store or determine a desired pressure for the chambers 146*a*-146*c* in the carrier head 140. The controller 190 and pneumatic control system 170 can communicate. For example, the controller 190 can be configured to send commands to the pneumatic control system 170 in response to which the pneumatic control system applies the desired pressure to the pressure supply lines 160*a*-160*c*. The controller 190 can include a computer program product implemented in non-transient computer readable media to perform these and other operations.

The pneumatic control system 170 includes a sensor 176 for each pressure supply line 160*a*-160*c*. The sensor 176 is configured to detect the pressure in the pressure supply line 160*a*-160*c*, and thus the pressure applied to the chamber 142*a*-142*c*. The measured pressure can be used in a feedback loop in the pneumatic control system 170 so the actual pressure in the pressure supply lines 160*a*-160*c* more closely matches the desired pressure received from the controller 190. Although illustrated as located in the pneumatic control system 170, the sensor 176 could be at another position along the pressure supply line 160*a*-160*c* or even within the carrier head 140.

Despite the use of a feedback loop, the actual pressure in a pressure supply line 160*a*-160*c* might not match the desired pressure, e.g., if a part is failing and there is a leak or similar problem.

A memory device 200 can be removably connected to the pneumatic control system 170. The memory device 200 can be a flash memory card, although another memory device such as miniaturized hard drive is possible. The memory device 200 can be manually removably connected to a data port of a pneumatic control system 170. For example, the data port can be a universal serial bus (USB) port, e.g., a USB receptacle, and the memory device 200 can be a USB mass storage device, e.g., a USB flash memory drive.

The pneumatic control system 170 is configured to record the output from the sensors 176 on the memory device 200. The pneumatic control system 170 can be configured to sample the sensors 176 at a relatively high sampling rate, e.g., 10 Hz or more, e.g., 100 Hz, and store the sampled output of the sensors 176 on the memory device 200. Due to the limited memory of the memory device 200, only the sensor signals acquired during processing of a number of the most recent substrates can be recorded. For example, the memory device 200 can record the sensor readings for the most recent five to twenty substrates.

The pneumatic control system 170 can include its own processor, memory and I/O system programmed to perform the sampling and recording, as well as to perform the feedback control of the pressure.

The memory device 200 can be removed either during regular maintenance of the carrier head 140 and/or upper pressure assembly, or following a fault in the carrier head and/or upper pressure assembly.

In the case of a fault, the sensor readings obtained during processing of the substrate can be analyzed to better understand the factors causing the fault. For example, depressurization of a particular chamber can indicate the location where a membrane failed.

Some semiconductor device manufacturers have repair or maintenance of the carrier head and/or upper pressure assembly performed by another party, e.g., by the manufacturer of the equipment. Having the memory device 200 be manually detachable permits the acquired sensor data to be easily transferred to the party performing the repair or maintenance. For example, in case of a fault, both the carrier head 140 and the memory device 200 can be removed and sent together to the repair facility.

In the case of regular maintenance, the sensor readings can be compared against a "gold signatures" for the sensors. The gold signatures can be obtained by measuring and recording the sensor readings during processing of a substrate that does not undergo a fault. Deviations from the gold signatures can indicate a part that is likely to fail and may need early replacement. This enables the operator to create prediction algorithms to avoid catastrophic failures, schedule protective maintenance, and minimize tool down time.

In some implementations, the gold signatures can be stored on the memory device 200, and the pneumatic control system 170 can be configured to compare the sensor readings to the gold signatures. Again, deviations from the gold signatures can indicate that a part is likely to fail and that the carrier head and/or upper pressure assembly should undergo maintenance. The pneumatic control system 170 and/or the controller 190 can be configured to generate an alert, e.g., an audible or visual signal, or an electronic message that is sent to the controller 190, if the sensor signals deviate by more than a threshold amount from the gold signatures.

In some implementations, an RFID device 210 can be embedded into the carrier head 140. The RFID device 210 head can include a non-volatile memory. The system 100 can include an RFID scanner 220. The RFID scanner 220 can be used to track when a carrier head is removed or attached to the polishing system 100. Data that can be stored in the memory of the device 210 and tracked include an identification code for the carrier head 140, the date(s) the carrier head 140 is installed and/or removed from the system 100, and the number of substrates polished with the carrier head 140. In addition, the RFID scanner can be used to move data stored in the non-volatile memory into a separate storage system, e.g., the controller 190.

A number of embodiments have been described. Nevertheless, it will be understood that various modifications may be made. For example, although the carrier head has been described as part of a chemical mechanical polishing apparatus, it may be adaptable to other types of processing systems, e.g., wafer transfer robots or electroplating systems. In the CMP system, the platen need not be rotatable or could be omitted entirely, and the pad could be circular or linear and could be suspended between rollers rather than attached to a platen.

Accordingly, other embodiments are within the scope of the following claims.

What is claimed is:

1. A pressure control assembly for a carrier head of a polishing apparatus, comprising:

a support movable relative to a platen;

a pressure supply line configured to fluidically connect to a chamber of a carrier head mounted on the support;

a sensor to responsive to pressure in the chamber and configured to generate a signal representative of the pressure;

a pneumatic control unit including a data port configured to detachably receive a storage device, the pneumatic control unit and data port mounted on the support that is movable relative to the platen, the pneumatic control unit configured to receive the signal, to control a pressure applied to the pressure supply line, and to record the signal in a non-transitory persistent storage media of a storage device removably attached to the pneumatic control unit, and a computer spaced apart from the support and electronically coupled to the pneumatic control unit, the computer configured to store a desired pressure and send a command to the pneumatic control unit to cause the pneumatic control unit to apply the desired pressure to the pressure supply line.

2. The assembly of claim 1, further comprising the storage device, and wherein the storage device comprises a flash memory.

3. The assembly of claim 1, wherein the data port comprises a USB port and the pneumatic control unit is configured to record the signal to the storage device attached to the USB port.

4. The assembly of claim 1, wherein the pneumatic control unit is configured to record the signal acquired during processing of a plurality of substrates.

5. The assembly of claim 1, comprising a plurality of pressure supply lines configured to fluidically connect to chambers of the carrier head, comprising a plurality of sensors to responsive to pressures in the chambers and configured to generate signals representative of the pressures, and wherein the pneumatic control unit is configured to receive the signals and record the signals in the non-transitory storage media of the storage device.

6. The assembly of claim 1, wherein the support comprises a carousel.

7. The assembly of claim 1, wherein the pneumatic control unit is configured to cause the storage device to store signals received during processing of a most recent plurality of substrates held by the carrier head.

8. The assembly of claim 7, wherein the most recent plurality of substrates comprises at most 20 substrates.

9. The assembly of claim 7, wherein processing of the plurality of substrates includes one or more of loading or unloading the substrate at a loading station, sensing the presence of the substrate, chucking or dechucking the substrate from the polishing pad, or polishing the substrate.

10. The assembly of claim 1, wherein the pneumatic control unit is configured to sample the signal at a sampling rate to generate a sequence of measured signal values, and is configured to store the sequence of measured signal values to record the signal.

11. The assembly of claim 10, wherein the sampling rate is at least 10 Hz.

12. The assembly of claim 1, wherein the pressure control unit is configured to compare the signal to a signature stored in the storage device.

13. The assembly of claim 12, wherein the pressure control unit is configured to generate an alert if the signal deviates by more than a threshold from the signature.

* * * * *